United States Patent [19]

Fiorio

[11] 4,396,686

[45] Aug. 2, 1983

[54] ROOFING ELEMENT FOR ROOFS OF BUILDINGS

[76] Inventor: Guido Fiorio, Corso Lodi 106, Milan, Italy

[21] Appl. No.: 433,379

[22] Filed: Oct. 8, 1982

[30] Foreign Application Priority Data

Oct. 6, 1981 [IT] Italy ..... 23129/81[U]

[51] Int. Cl.[3] ..... E04D 3/35; E04D 11/02; B32B 5/16; B32B 5/18

[52] U.S. Cl. ..... 428/623; 52/309.8; 428/150; 428/160; 428/318.4; 428/319.1; 428/468; 428/626

[58] Field of Search ..... 52/309.4, 309.8; 428/143, 150, 160, 314.4, 314.8, 318.4, 319.1, 468, 469, 623, 626

[56] References Cited

U.S. PATENT DOCUMENTS 2,073,334 3/1937 Coffman ..... 428/622
3,535,198 10/1970 Bloom ..... 428/318.4
4,122,203 10/1978 Stahl ..... 428/318.4
4,206,267 6/1980 Jungbluth ..... 428/623
4,351,873 9/1982 Davis ..... 428/489

FOREIGN PATENT DOCUMENTS 468843 10/1950 Canada ..... 428/468

*Primary Examiner*—William J. Van Balen
*Attorney, Agent, or Firm*—Schwartz, Jeffery, Schwaab, Mack, Blumenthal & Koch

[57] ABSTRACT

A roofing element for roofs of civil and industrial buildings comprising a layer of expanded polyurethane having high thermal insulation capacity, a support made of zinc-plated sheet steel overlying said layer of expanded polyurethane and adhering thereto at all points, a thin layer of a bituminous compound and a continuous layer of stone material in fine scales caused to adhere to said thin layer of bituminous compound.

1 Claim, 3 Drawing Figures

ROOFING ELEMENT FOR ROOFS OF BUILDINGS

Figure 1A:
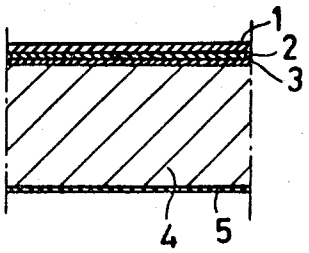

The present invention relates to a roofing element for roofs of buildings, both for civil and industrial use.

The roofing element according to the present invention is characterized by the fact that it comprises, in combination, the following components:

(a) a layer of expanded polyurethane having a high degree of thermal insulation;

(b) a support made of zinc-plated sheet metal overlying said layer of expanded polyurethane (a) and adherent thereto at all points;

(c) a thin layer of a bituminous compound, and (d) a continuous layer of stone material in fine scales caused to adhere to said thin layer of bituminous compound as defined at (c).

The principal purpose of the present invention is to provide a complete and finished monolithic element, large in size but nevertheless easy to handle and light in weight, such as can be readily applied to roofs or other coverings of civil and industrial buildings.

The finished articles obtained according to the present invention lend themselves very satisfactorily to applications in locations where winter temperatures are low, inasmuch as the layer of expanded polyurethane as defined above at (a) cooperates with a layer of bituminous compound (c) (about 2 mm thick) as well as with the upper layer of stone material in the form of scales, to provide an excellent thermal insulation and also protection against weathering.

As a result of its plastic nature, moreever, the bituminous layer makes it possible to seal the joints—always required—hermetically, thus excluding all risk of infiltration of water, dust or other contaminating agents in general, whether originating from the atmosphere or elsewhere.

The preparation of the element according to the invention does not entail any particular difficulties and its installation is likewise very simple.

The dead load of the roofing embodied with elements according to the present invention is only approximately 10 kg/m$^2$ of surface area covered; it will readily be seen therefore that it is not necessary to use particularly robust bearing stuctures to support the roofing, and it is in this regard pertinent to note that the overloads due to wind and snow for which provision must be made at the planning stage greatly exceed said unit weight.

Although not falling strictly within the scope of the present invention, mention should be made of the fact that the stone material in the form of scales on the bituminous layer provides solutions of particular aesthetic and chromatic value. A material very suitable is slate in small scales of average size of a few millimeters or even, if required, fractions of a millimeter.

It is, finally, extremely simple to remove the roofing made up of the elements according to the present invention and re-install it elsewhere on other bearing structures.

Figure 1:
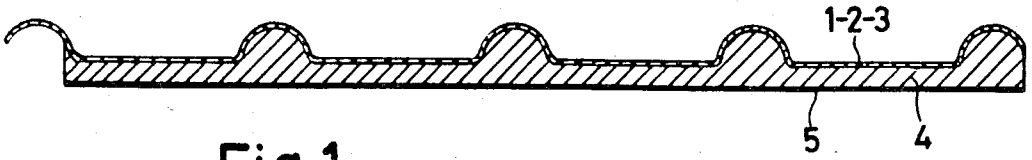
Figure 2:
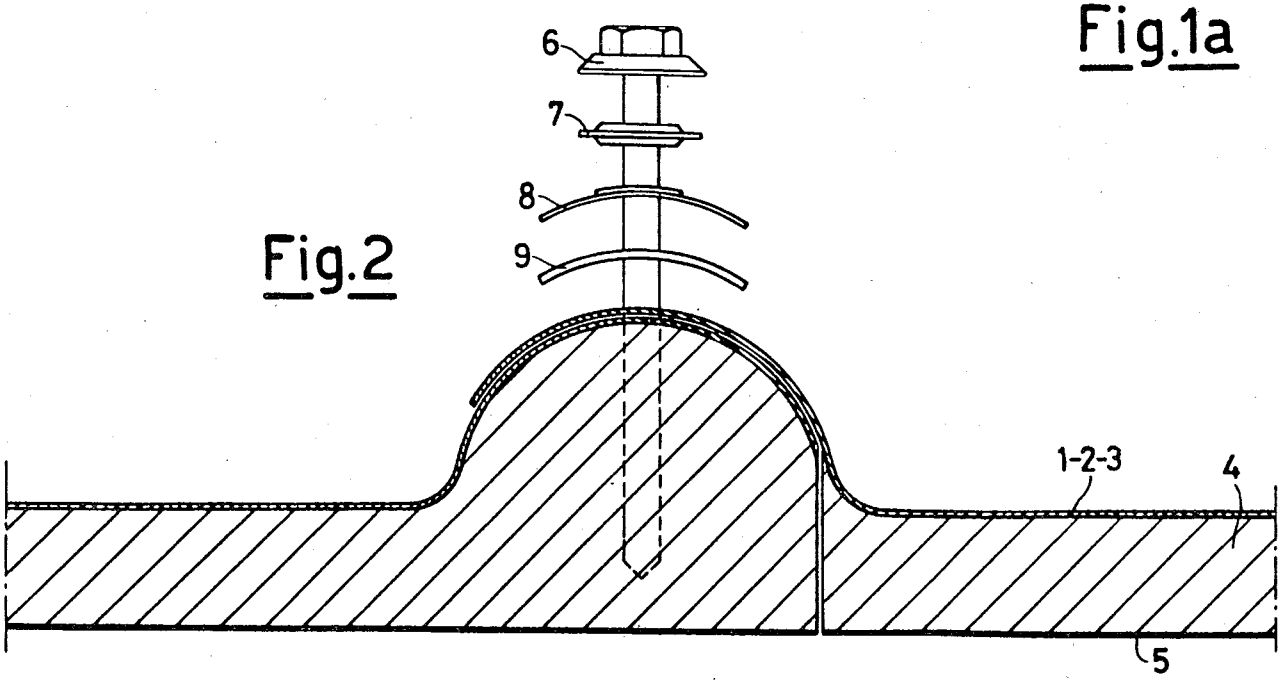

The invention will be more clearly comprehended from the following description of a typical realization thereof, to which obvious variants within the scope of a person skilled in the art are always possible within the framework of the above defined inventive concept. The description is accompanied by the attached drawings, in which:

FIG. 1 is a schematic sectional view of the roofing element according to the invention;

FIG. 1*a* shows a more detailed section which clearly shows, in the order stated, all the components of said element, and FIG. 2 shows a practical example of application, and in particular the jointing of two adjacent elements and their securing to any bearing structure (not shown).

FIGS. 1 and 1*a*, seen from top to bottom, show how the roofing element comprises a layer of stone scales, 1, a layer of bituminous compound, 2, a layer of sheet steel, 3, which can be smooth or ribbed as building requirements dictate, a fairly thick layer (of the order of a few centimeters) of expanded polyurethane of high heat insulation capacity, 4. Optionally, provision can be made in the soffit of the layer, 4, for a coat of any coating material, as for example Kraft paper 5, aluminized paper and other coatings in general.

FIG. 2 clearly shows the layers represented in the previous drawings and also the ease in which two adjacent elements can be jointed, for example by overlaying of the ribbed portions. The figure also shows conventional connecting elements such as the screw 6, the washer 7, the cap 8, and the packing 9, which are all well known for securing roofing to bearing structures and which are here represented to complete the description, and in a schematic manner intended only as an indication.

The present invention has already made it possible to provide an efficient roofing for large surface areas at small expense with continuous elements which are themselves of elevated surface area.

It is thus easible to conceive of monolithic roofing structures for large-area roofed areas.

I claim:

1. A roofing element for roofs of civil and industrial buildings, characterized in that it comprises, in combination:

(a) a layer of expanded polyurethane having high thermal insulation capacity;

(b) a support made of zinc-plated sheet steel overlying said layer (a) of expanded polyurethane and adhering thereto at all points;

(c) a thin layer of a bituminous compound, and (d) a continuous layer of stone material in fine scales caused to adhere to said thin layer of bituminous compound as defined at (a).

* * * * *